United States Patent [19]

Hansen

[11] 4,448,383

[45] May 15, 1984

[54] ADJUSTABLE TELEPHONE MESSAGE HOLDER

[76] Inventor: Robert S. Hansen, P.O. Box 1040, Doylestown, Pa. 18901

[21] Appl. No.: 383,286

[22] Filed: May 28, 1982

[51] Int. Cl.[3] ..... A47B 19/00

[52] U.S. Cl. ..... 248/447.1; 248/291; 248/454; 403/93

[58] Field of Search ..... 248/467, 441 B, 454, 248/291, 297, 474; 403/93, 94, 96; 179/146

[56] References Cited

U.S. PATENT DOCUMENTS

| | | | |
|---|---|---|---|
| D. 229,757 | 12/1974 | Hansen | D19/86 X |
| 793,826 | 7/1905 | Damico | 248/441 BX |
| 1,009,508 | 11/1911 | Guthrie | 248/454 |
| 1,541,679 | 6/1925 | Beenk | 248/441 B |
| 1,889,742 | 12/1932 | Barclay | 248/229 |
| 2,052,331 | 8/1936 | White | 403/93 X |
| 3,410,513 | 11/1968 | Wolf | 248/467 X |

FOREIGN PATENT DOCUMENTS

| | | | |
|---|---|---|---|
| 2949135 | 12/1979 | Fed. Rep. of Germany | 248/441 B |

*Primary Examiner*—J. Franklin Foss
*Assistant Examiner*—David L. Talbott
*Attorney, Agent, or Firm*—Flehr, Hohbach, Test, Albritton & Herbert

[57] ABSTRACT

Adjustable message holder for use with telephones. The message holder has a pivotally mounted message holding arm which can be adjusted to a convenient angle for holding messages regardless of the orientation of the surface on which the device is mounted, whereby the message holder can be employed with a number of different types of telephone instruments.

8 Claims, 4 Drawing Figures

FIG_1
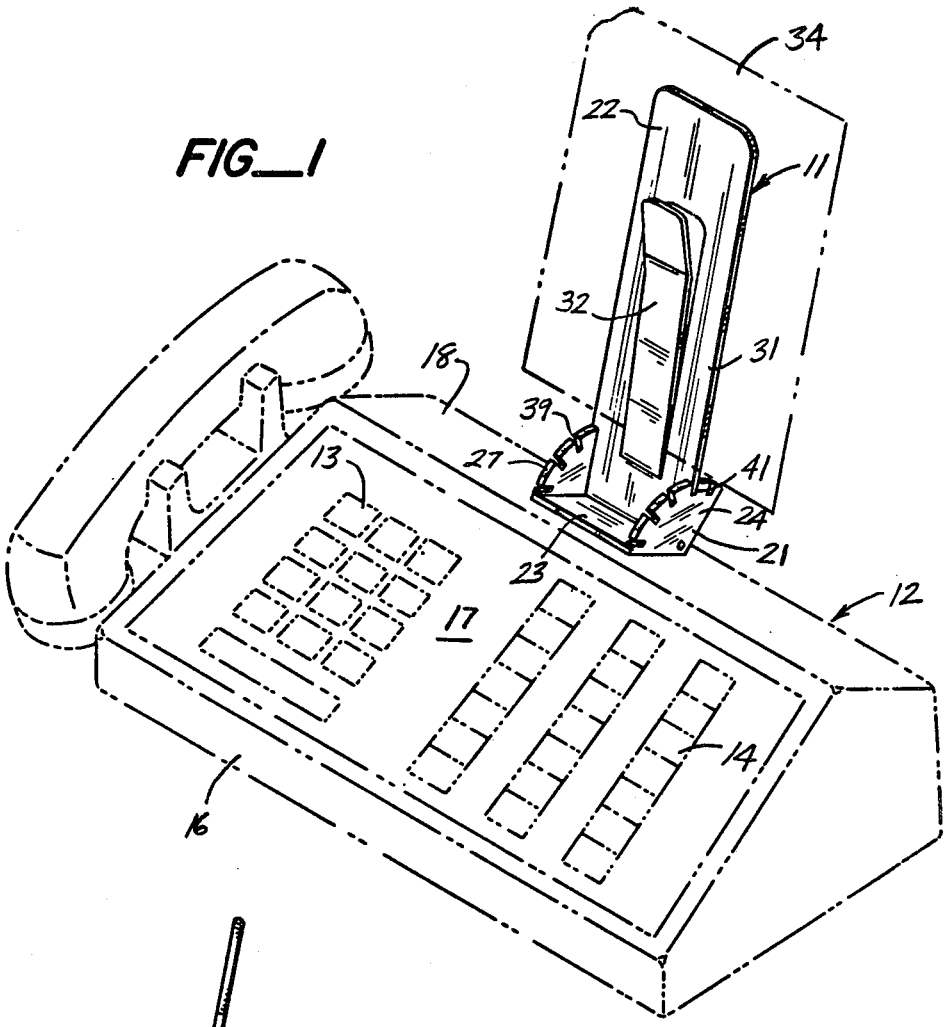
FIG_2
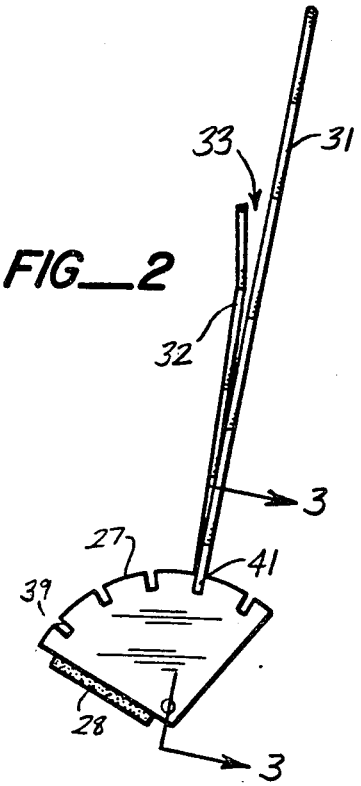
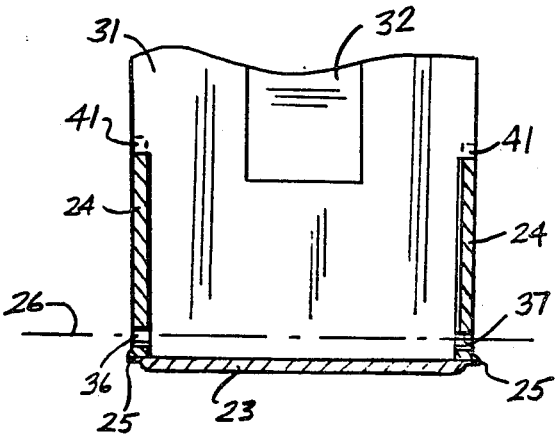
FIG_3

ADJUSTABLE TELEPHONE MESSAGE HOLDER

This invention pertains generally to telephone message holders, and more particularly to an adjustable message holder which can be employed with different types of telephone instruments.

Message holders heretofore provided for use with telephones have generally been limited to a particular type of telephone instrument. For example, U.S. Pat. No. 229,757 shows a message holder which is designed for use with a standard desk-type telephone and is mounted on the instrument by snapping into the finger hold recess at the rear of the instrument. U.S. Pat. No. 1,889,742 shows a message holder designed for interlocking engagement with one of the four upstanding prongs which form a cradle for the handset of another telephone. U.S. Pat. No. 3,410,513 shows a message pad which is mounted on the side of a telephone instrument and is folded flat against the side of the instrument when not in use.

It is in general an object of the invention to provide a new and improved message holder for use with telephone instruments.

Another object of the invention is to provide a message holder of the above character which is adjustable and can be employed with different types of telephone instruments.

These and other objects are achieved in accordance with the invention by providing a message holder having a base which is mounted in a stationary position on the telephone instrument, and a message holding arm which is hingedly connected to the base and movable between a plurality of angular positions relative to the base. Detent means holds the arm in a selected one of the angular positions whereby the arm can be positioned to extend from the telephone instrument at a convenient angle for holding messages regardless of the orientation of the surface on which the holder is mounted.

FIG. 1 is an isometric view of one embodiment of a telephone message holder according to the invention, mounted on one type of telephone instrument.

FIG. 2 is a side elevational view of the embodiment of FIG. 1.

FIG. 3 is an enlarged fragmentary cross sectional view taken along Line 3—3 in FIG. 2.

Figure 4:
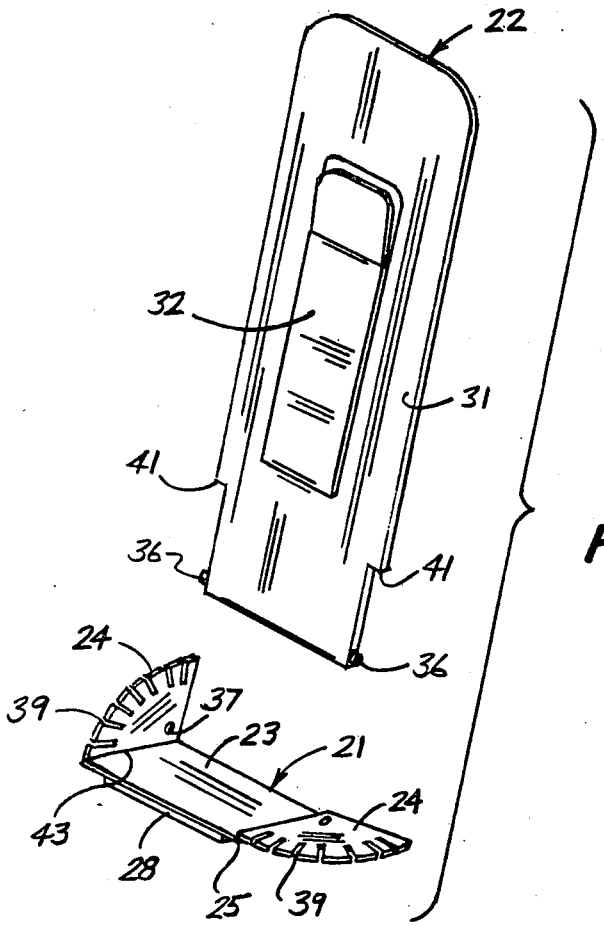
FIG. 4 is an exploded isometric view of the embodiment of FIG. 1.

In FIG. 1 the message holder 11 is illustrated in connection with a telephone instrument 12 of the type commonly known as a call director. In addition to the usual dialing keyboard 13, this instrument also has additional keys 14 and circuitry not shown for directing calls between one or more external lines and a plurality of extension stations associated with the instrument. The instrument includes a cabinet 16 having a sloping front panel 17 on which keyboard 13 and keys 14 are located. The instrument is adapted to rest on a desk or other suitable supporting surface (not shown), and the cabinet includes a top wall 18 which slopes downwardly and rearwardly from front panel 17. The angle of inclination of top wall 18 varies between different telephone instruments, ranging from substantially horizontal in some instruments to substantially vertical in others.

Message holder 11 includes a base 21 which is mounted in a stationary position on top wall 18 of the telephone instrument, and a message holding arm 22 which is hingedly connected to the base and can be positioned at a convenient angle for holding messages regardless of the angle at which the top wall is inclined.

As illustrated, base 21 comprises a generally U-shaped member having a generally rectangular central portion 23 and a pair of sector shaped flanges 24 which are connected along opposite edges of the central portion by relatively thin, flexible webs 25. In the assembled state, flanges 24 extend from opposite sides of the central portion in spaced parallel relation. Message holding arm 22 is adapted for movement about an axis 26 which extends in a direction generally perpendicular to the flanges, and each of the flanges has a curved edge portion 27 which extends along an arcuate path centered about the axis.

An adhesive backing 28 is affixed to the side of base portion 23 opposite flanges 24 to provide means for securing the message holder in a desired position on the telephone instrument. Prior to use, the adhesive backing is covered with a protective covering (not shown) which is removed and discarded when the message holder is installed on the instrument.

Message holding arm 22 comprises an elongated generally planar body portion 31 which is hingedly connected toward one end thereof to base 21. An elongated tongue 32 extends longitudinally of the body portion, and the end of the tongue toward the hinge is affixed to the body portion, whereby a clip 33 for holdling messages 34 is formed between the tongue and the body portion. In this embodiment, the body portion and the tongue are formed as a unitary structure, with the tongue being cut out along three edges from the body portion and bent to the desired shape.

Pivot pins 36 project along hinge axis 26 from the lateral edges of arm 22 and are rotatively received in sockets 37 formed in flanges 24. In the embodiment illustrated, the pins are formed as an integral part of the arm, but a separate pin or pins can be employed, if desired. Alternatively, the arm can be hingedly connected to the base by any other suitable means such as a flexible web interconnecting the arm and the base.

Detent means is provided for releasably holding arm 22 in a plurality of angular positions relative to base 21. This means comprises a plurality of spaced apart notches 39 which open through the curved edge surfaces of flanges 24. The notches are arranged in pairs, with the two notches in each pair being positioned in lateral registration with each other on the respective flanges. The lower corners of body portion 31 are cut away to form shoulders 41 which extend laterally and are received in the notches to hold the arm in a desired position. The width of the shoulders is approximately equal to the thickness of the flanges, and the circular edge portions of the flanges can be deflected away from each other to disengage the shoulders from the notches and permit movement of the arm between different positions.

In the preferred embodiment, base 21 and arm 22 are each fabricated as a unitary structure of a transparent thermoplastic material such as polycarbonate or polypropylene. However, other suitable materials and/or coloration can be employed, if desired. It should be noted that flanges 24 are offset from central section 23, with the outer surfaces of the flanges being generally aligned with the upper surface of the central section when the base is in its unfolded or generally flat condition. When the flanges are in their upright position, the lower edges 43 of the flanges abut against the upper surface of the central section.

Operation and use of the message holder is as follows. The protective covering is removed from adhesive backing 28, and the message holder is mounted in a suitable position on the telephone instrument, e.g., on the rearwardly inclined top surface 18 of the instrument illustrated in FIG. 1. The angle between arm 22 and base 21 is adjusted so that messages held by the arm will be readily visible regardless of the inclination of the surface on which the base is mounted. This adjustment is made by separating flanges 24 to free shoulders 41 from notches 39 and moving the arm into alignment with the pair of notches which correspond most closely to the desired position. The flanges are then returned to their original position whereby the shoulders are received in the notches and the arm is locked in the desired position.

The invention has a number of important features and advantages. Being adjustable, it can be employed with almost any telephone instrument, and it can be positioned to hold messages at a convenient angle for viewing regardless of the inclination of the surface on which the message holder is mounted. In addition, it is economical to manufacture and convenient and easy to use.

It is apparent from the foregoing that a new and improved message holder for telephones has been provided. While only one presently preferred embodiment has been described in detail, as will be apparent to those familiar with the art, certain changes and modifications can be made without departing from the scope of the invention as defined by the following claims.

What is claimed is:

1. In a message holder for use with a telephone instrument: a base of substantially smaller lateral extent than the telephone instrument mounted in a stationary position on the telephone instrument and having a generally planar flange projecting therefrom, an elongated message holding arm hingedly connected to the base for pivotal movement about an axis generally perpendicular to the flange, and detent means carried by the flange for selectively retaining the message holding arm in a plurality of different angular positions relative to the base, wherein the detent means comprises a plurality of notches formed in the flange and spaced along an arcuate path centered about the hinge axis for engagement with an edge portion of the arm.

2. The message holder of claim 1 wherein the base is generally rectangular and has a pair of generally planar flanges projecting from opposite sides thereof in spaced parallel relation, detent means being carried by each of said flanges for engagement with the message holding arm.

3. The message holder of claim 2 wherein the flanges are generally sector shaped and have curved edge portions extending along arcuate paths centered about the hinge axis, and the detent means comprises a plurality of notches spaced apart along the curved edge portions of the flanges.

4. The message holder of claim 1 wherein the message holding arm is hingedly connected to the base by means of an axially extending pin which projects laterally from one edge of the arm and is pivotally received in a socket in the flange.

5. A telephone message holder comprising a base having a generally planar area with adhesive means on one side thereof for affixing the base to a telephone, a pair of sector shaped flanges projecting in spaced parallel relation from the side of the base opposite the adhesive means, a message holding arm pivotally connected to the base movement about an axis perpendicular to the flanges, said arm including an elongated, generally planar body portion and an elongated tongue connected at one end to the body portion and extending in a direction generally parallel to the body portion to form a clip for holding messages, and detent means carried by the flanges and the message holding arm for holding the arm in a plurality of angular positions relative to the base, wherein the detent means comprises a plurality of notches spaced along the peripheral edges of the sector shaped flanges for engaging the edge portions of the message holding arm in holding relationship.

6. The message holder of claim 5 wherein the lower portions of the edge portions of the arm are cut away to form shoulders which are received in the notches.

7. The message holder of claim 5 wherein the message holding arm has pivot means which project laterally from the body portion of the arm along the pivot axis, and the flanges have sockets positioned on the axis in which the pins are received.

8. The message holder of claim 5 wherein the sector shaped flanges are hingedly connected to the base, and the message holding arm is removably connected to the base whereby the message holder can be folded flat for shipment and storage.

* * * * *